US010865354B2

(12) United States Patent
Shetkar et al.

(10) Patent No.: US 10,865,354 B2
(45) Date of Patent: Dec. 15, 2020

(54) MARINE FUEL COMPOSITIONS WITH REDUCED ENGINE FRICTIONAL LOSSES

(71) Applicant: ExxonMobil Research and Engineering Company, Annandale, NJ (US)

(72) Inventors: Aditya S. Shetkar, Houston, TX (US); Kenneth C. H. Kar, Philadelphia, PA (US); Scott K. Berkhous, Center Valley, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 16/811,233

(22) Filed: Mar. 6, 2020

(65) Prior Publication Data

US 2020/0291318 A1 Sep. 17, 2020

Related U.S. Application Data

(60) Provisional application No. 62/816,396, filed on Mar. 11, 2019.

(51) Int. Cl.

| | |
|---|---|
| ***C10L 1/04*** | (2006.01) |
| ***C10L 1/08*** | (2006.01) |
| ***C10M 105/06*** | (2006.01) |
| ***C10M 171/02*** | (2006.01) |
| *C10N 40/25* | (2006.01) |

(Continued)

(52) U.S. Cl.

CPC ..... *C10L 1/08* (2013.01); *C10M 105/06* (2013.01); *C10M 171/02* (2013.01); *C10L 2200/0446* (2013.01); *C10L 2270/026* (2013.01); *C10M 2203/065* (2013.01); *C10N 2020/02* (2013.01); *C10N 2030/02* (2013.01); *C10N 2040/253* (2020.05)

(58) Field of Classification Search

CPC ..... C10L 1/04; C10L 2200/0438; C10L 2270/026; C10L 2200/0446

See application file for complete search history.

(56) References Cited

U.S. PATENT DOCUMENTS

| | | | | |
|---|---|---|---|---|
| 2009/0158639 | A1* | 6/2009 | Null | C10L 1/026 44/308 |
| 2009/0158641 | A1* | 6/2009 | Hayes | C10L 1/04 44/309 |
| 2009/0165760 | A1 | 7/2009 | Buttery et al. | |

(Continued)

OTHER PUBLICATIONS

The International Search Report and Written Opinion of PCT/US2020/021358 dated May 27, 2020.

(Continued)

*Primary Examiner* — Long T Tran

(74) *Attorney, Agent, or Firm* — Robert A. Migliorini

(57) ABSTRACT

Marine gas oil compositions corresponding to fuels and/or fuel blending components are provided that can provide improved friction properties within an engine. Addition of lubricant base stock to a marine gas oil composition can reduce frictional losses within an engine during operation. The benefits in reduction of frictional losses can be observed based on the difference between the indicated mean effective pressure and the actual work delivered by an engine, where the difference corresponds to the frictional mean effective pressure.

20 Claims, 9 Drawing Sheets

(51) Int. Cl.
*C10N 20/02* (2006.01)
*C10N 30/02* (2006.01)

(56) References Cited

U.S. PATENT DOCUMENTS

| | | | | |
|---|---|---|---|---|
| 2012/0080357 | A1* | 4/2012 | Novak | C10G 47/18 208/49 |
| 2012/0246999 | A1* | 10/2012 | Stern | C10L 1/1616 44/300 |
| 2017/0002273 | A1* | 1/2017 | Rubin-Pitel | C10G 45/00 |
| 2017/0002279 | A1 | 1/2017 | Brown et al. | |
| 2017/0183575 | A1* | 6/2017 | Rubin-Pitel | C10L 1/08 |
| 2017/0306253 | A1* | 10/2017 | Wrigley | C10G 7/00 |
| 2017/0335217 | A1* | 11/2017 | Hommeltoft | C07C 2/58 |
| 2018/0371343 | A1 | 12/2018 | Rubin-Pitel et al. | |

OTHER PUBLICATIONS

Klaus Reders et al:"Marine Fuels" in: "Ullmann's Encyclopedia of Industrial Chemistry", Jul. 15, 2015.

* cited by examiner

MARINE FUEL COMPOSITIONS WITH REDUCED ENGINE FRICTIONAL LOSSES

CROSS-REFERENCE TO RELATED APPLICATIONS

This application claims the benefit of U.S. Provisional Application No. 62/816,396, filed on Mar. 11, 2019, the entire contents of which are incorporated herein by reference.

FIELD

Compositions and methods for making compositions are provided related to marine fuels and/or fuel blending components that provide reduced engine frictional losses.

BACKGROUND

Marine gas oils correspond to marine fuels that satisfy various specifications for kinematic viscosity, density and/or other features. For example, the specifications for a DMA grade marine gas oil under ISO 8217 include a kinematic viscosity at 40° C. of 2.0 cSt to 6.0 cSt, a calculated cetane index of 40 or more (ASTM D4737), and a density at 15° C. of 890 kg/m$^3$ or less. As another example, the specifications for a DMB grade marine gas oil under ISO 8217 include a kinematic viscosity at 40° C. of 2.0 cSt to 11.0 cSt, a calculated cetane index of 40 or more, an a density at 15° C. of 900 kg/m$^3$ or less. Marine gas oils that can satisfy such specifications are typically composed primarily of distillate boiling range components. In addition to providing fuel for the engines, marine gas oil can also be used as a fuel for various generators used on a marine vessel.

In addition to the specifications in ISO 8217, additional concerns for marine gas oils can be related to the amount and types of emissions generated from combustion of a fuel. As promulgated by the International Maritime Organization (IMO), issued as Revised MARPOL Annex VI, marine fuels will be capped globally with increasingly more stringent requirements on sulfur content. In addition, individual countries and regions are beginning to restrict sulfur level used in ships in regions known as Emission Control Areas, or ECAs. Based on this increasing regulatory scrutiny of marine fuels, it would be desirable to develop marine fuels that can provide reduce or minimized emissions while still maintaining flexibility regarding the types of components that can be included within a marine fuel composition.

U.S. Patent Application Publication 2009/0165760 describes a method of operating a turbo charged diesel engine where a viscosity-increasing component is added to the diesel fuel to improve acceleration performance at low engine speeds.

U.S. Patent Application Publication 2018/0371343 describes marine fuel oil compositions and marine gas oil compositions where a portion of the composition corresponds to a hydroprocessed deasphalted oil. The various marine fuel compositions are described as potentially including 0.5 wt % to 80 wt % of the hydroprocessed deasphalted oil.

SUMMARY

In various aspects, a marine gas oil composition is provided. The marine gas oil composition can include 1.0 vol % to 25 vol % of a lubricant base stock, such as 1.0 vol % to 12 vol % of a heavy neutral lubricant base stock, or 1.0 vol % to 5.0 vol % of a brightstock. The lubricant base stock can include one or more of a T5 distillation point of 350° C. or more, a kinematic viscosity at 100° C. of 3.0 cSt or more, and a viscosity index of 80 or more. The marine gas oil composition can include one or more of a density at 15° C. of 0.81 g/cm$^3$ to 0.90 g/cm$^3$, a calculated cetane index of 40 or more, and a kinematic viscosity at 40° C. of 2.0 cSt to 11.0 cSt. The marine gas oil composition can be used to operate an engine.

DETAILED DESCRIPTION

Figure 1:
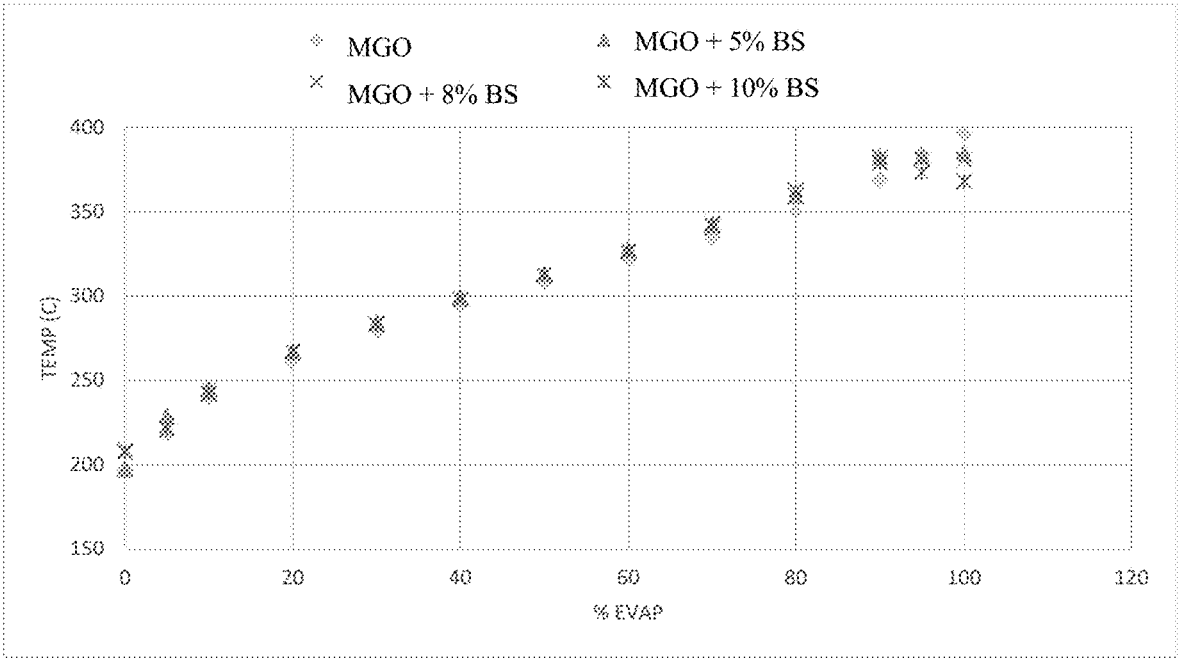
FIG. 1 shows distillation curves for marine gas oil compositions that include various amounts of brightstock.

All numerical values within the detailed description and the claims herein are modified by "about" or "approximately" the indicated value, and take into account experimental error and variations that would be expected by a person having ordinary skill in the art.

In various aspects, marine gas oil compositions corresponding to fuels and/or fuel blending components are provided that can provide improved friction properties within an engine. It has been discovered that addition of lubricant base stock to a marine gas oil composition (fuel or fuel blending component) can reduce frictional losses within an engine during operation. The benefits in reduction of frictional losses can be observed, for example, based on the difference between the indicated mean effective pressure and the actual work delivered by an engine, where the difference corresponds to the frictional mean effective pressure.

Although lubricant base stocks typically have a boiling range that is higher than the typical components for a marine gas oil, it has been further unexpectedly discovered that the lubricant base stocks can be added to a marine gas oil composition while minimizing or avoiding increases in pollutants generated during combustion. For example, the amount of soot, total hydrocarbons (THC), and/or NOx emitted during combustion of a marine gas oil composition containing lubricant base stock can be comparable to or less than a marine gas oil composition without the lubricant base stock. This is in contrast to conventional understanding, as higher boiling components within a fuel composition would generally be expected to lead to higher emission levels.

The friction-reducing benefits from addition of lubricant base stock to a marine gas oil can be realized for marine gas oil compositions containing relatively low amounts of lubricant base stock. For example, depending on the type of lubricant base stock, the amount of lubricant base stock can correspond to 1.0 vol % to 25 vol %, or 1.0 vol % to 12 vol %, or 1.0 vol % to 10 vol %, or 1.0 vol % to 5.0 vol %, or 3.0 vol % to 25 vol %, or 3.0 vol % to 10 vol %, or 3.0 vol % to 5.0 vol %. It has further been unexpectedly discovered that the amount of base stock that can be added to a marine gas oil to achieve a friction-reducing benefit can be determined using the method described in ASTM D86. Conventionally, the method in D86 is intended for determination of the distillation range of distillate fuels, and would not normally be considered suitable for characterization of the boiling range of composition that includes lubricant boiling range components. However, it has been discovered that the results from performing the D86 distillation method on a marine gas oil sample can be used to determine whether the amount of lubricant in the marine gas oil sample is low enough to provide the desired friction-reducing benefits and/or minimized pollutant benefits.

Lubricant Base Stocks as Blend Components for a Marine Gas Oil Composition

In various aspects, one or more lubricant base stocks can be used as blend components for forming a marine gas oil composition. In addition to the lubricant base stocks, the marine gas oil composition can include any other convenient type of blend components. Such blend components can include conventional marine gas oils, low sulfur diesel and/or ultra-low sulfur diesel, hydrocracked gas oils, and/or any other type of blend components that can typically be used for forming a marine gas oil.

The amount of the one or more lubricant base stocks in the marine gas oil composition can be 1.0 vol % to 25 vol %, or 1.0 vol % to 12 vol %, or 1.0 vol % to 10 vol %, or 1.0 vol % to 5.0 vol %, or 3.0 vol % to 25 vol %, or 3.0 vol % to 10 vol %, or 3.0 vol % to 5.0 vol %.

The one or more lubricant base stocks can have various properties that are typical of lubricant base stocks. For example, a lubricant base stock can have one or more of the following properties: a kinematic viscosity at 100° C. of 3.0 cSt to 40 cSt, or 4.0 cSt to 35 cSt; a kinematic viscosity at 40° C. of 14 cSt or more; a viscosity index of 75 to 140, or 80 to 140, or 80 to 110; a density at 15.6° C. of 0.85 to 0.88 g/cm$^3$; a T5 distillation point of 350° C. or more, or 400° C. or more; and/or a T95 distillation point of 425° C. to 575° C., or 425° C. to 550° C. Additionally or alternately, at least 50 vol % of the base stock can have a distillation point of 380° C. or more, or 400° C. or more. Further additionally or alternately, in various aspects, the marine gas oil composition can be clear and bright according to Procedure 1 of ASTM D4176.

In some aspects, at least one lubricant base stock can correspond to a light neutral base stock, a heavy neutral base stock, a bright stock, or a combination thereof. In aspects where a light neutral base stock is used as a blend component for a marine gas oil composition, the light neutral base stock can have a kinematic viscosity at 100° C. of 3.0 cSt to 6.0 cSt, or 3.5 cSt to 5.5 cSt; a kinematic viscosity at 40° C. of 14 cSt to 42 cSt, a viscosity index of 75 to 140, or 80 to 140, or 80 to 110; and a density at 15.6° C. of 0.85 to 0.87 g/cm$^3$. In such aspects, the amount of lubricant base stock can be 1.0 vol % to 25 vol %, or 1.0 vol % to 15 vol %, or 1.0 vol % to 5.0 vol %, or 3.0 vol % to 25 vol %, or 3.0 vol % to 15 vol %, or 3.0 vol % to 5.0 vol %.

In aspects where a heavy neutral base stock is used as a blend component for a marine gas oil composition, the heavy neutral base stock can have a kinematic viscosity at 100° C. of 6.0 cSt to 14 cSt, or 6.5 cSt to 12 cSt; a kinematic viscosity at 40° C. of 35 cSt to 160 cSt, a viscosity index of 75 to 140, or 80 to 140, or 80 to 110; and a density at 15.6° C. of 0.86 to 0.86 g/cm$^3$. In such aspects, the amount of lubricant base stock can be 1.0 vol % to 12 vol %, or 1.0 vol % to 10 vol %, or 1.0 vol % to 5.0 vol %, or 3.0 vol % to 12 vol %, or 3.0 vol % to 10 vol %, or 3.0 vol % to 5.0 vol %.

In aspects where a bright stock is used as a blend component for a marine gas oil composition, the bright stock can have a kinematic viscosity at 100° C. of 14 cSt to 40 cSt, or 16 cSt to 35 cSt, a kinematic viscosity at 40° C. of 115 cSt to 875 cSt, a viscosity index of 75 to 140, or 80 to 140, or 80 to 110; and a density at 15.6° C. of 0.85 to 0.88 g/cm$^3$. In such aspects, the amount of lubricant base stock can be 1.0 vol % to 5.0 vol %, or 3.0 vol % to 5.0 vol %.

In some aspects, a lubricant base stock fraction can correspond to a lubricant base stock formed from a bottoms stream from the hydroprocessing of a deasphalted oil. Such hydroprocessing can include hydrotreating, hydrocracking, catalytic dewaxing, and/or hydrofinishing at a severity sufficient to convert at least a portion of the bottoms of the hydroprocessed deasphalted oil into a lubricant base stock. The bottoms streams from hydroprocessing of deasphalted oil can be characterized by a beneficial combination of properties: a sulfur content of 0.1 wt % or less (or 100 wppm or less), an aromatics content of 5.0 wt % or less (or 1.0 wt % or less), and a viscosity index of 80 or more.

As an example, a bottoms fraction formed by hydroprocessing of a deasphalted oil can comprise a T10 distillation point of at least 370° C., or at least 400° C., or at least 500° C., or at least 550° C., and a T90 distillation point of 700° C. or less. In this type of example, the bottoms can have a density at 70° C. of 0.86 g/cm$^3$ or less, or 0.85 g/cm$^3$ or less, such as down to 0.80 g/cm$^3$ or less. In this type of example, the bottoms can include at least 75 wt % saturates, or at least 80 wt %, or at least 90 wt %. A portion of the saturates can correspond to naphthenes. Relative to the weight of the bottoms, the naphthene content can be at least 50 wt %, or at least 60 wt %, such as up to 80 wt % or more. The bottoms can have a calculated carbon aromaticity index of 760 or less, or 740 or less and/or a Conradson carbon content of 1.5 wt % or less, or 1.0 wt % or less, or 0.5 wt % or less. The sulfur content can be 100 wppm or less, or 50 wppm or less, or 20 wppm or less. The kinematic viscosity at 100° C. can be at least 15 cSt, or at least 25 cSt, or at least 40 cSt.

Where lubricant boiling range material (such as lubricant boiling range material generated by hydroprocessing of deasphalted oil) is used as a blendstock for marine gasoil (MGO) blending, it may be blended with other streams including/not limited to any of the following, and any combination thereof, to make an on-spec marine gasoil fuel: low sulfur diesel (sulfur content of less than 500 wppm), ultra low sulfur diesel (sulfur content <10 or <15 ppmw), low sulfur gas oil, ultra low sulfur gasoil, low sulfur kerosene, ultra low sulfur kerosene, hydrotreated straight run diesel, hydrotreated straight run gas oil, hydrotreated straight run kerosene, hydrotreated cycle oil, hydrotreated thermally cracked diesel, hydrotreated thermally cracked gas oil, hydrotreated thermally cracked kerosene, hydrotreated coker diesel, hydrotreated coker gas oil, hydrotreated coker kerosene, hydrocracker diesel, hydrocracker gas oil, hydrocracker kerosene, gas-to-liquid diesel, gas-to-liquid kerosene, hydrotreated fats or oils such as hydrotreated vegetable oil, hydrotreated tall oil, etc., fatty acid methyl esters, hydrotreated pyrolysis diesel, hydrotreated pyrolysis gas oil, atmospheric tower bottoms, vacuum tower bottoms and any residue materials derived from low sulfur crude slates, straight-run diesel, straight-run kerosene, straight-run gas oil and any distillates derived from low sulfur crude slates, gas-to-liquid wax, and other gas-to-liquid hydrocarbons. Additionally, additives may be used to correct properties such as pour point, cold filter plugging point, lubricity, cetane, conductivity, and/or stability.

As needed, fuel or fuel blending component fractions that include lubricant base stocks and/or lubricant boiling range material may be additized with additives such as pour point improver, cetane improver, lubricity improver, etc. to meet local specifications.

In various aspects, the lubricant base stock can be blended into a composition corresponding to a marine gas oil composition, such as a marine gas oil composition that satisfies one or more specifications (such as up to all specifications) related to an ISO 8217 DMA grade marine gas oil. Such specifications can include having a kinematic viscosity at 40° C. of 2.0 to 6.0 cSt (ASTM D445), a calculated cetane index of 40 or more (ASTM D4737), a density at 15° C. of 0.89 g/cm$^3$ or less (ASTM D1298), an ash content of 0.01 wt % or less (ASTM D482), and a lubricity of 520 μm or less. In other aspects, the lubricant base stock can be blended into a composition corresponding to a marine gas oil composition that satisfies one or more specifications (such as up to all specifications) related to an ISO 8217 DMB grade marine gas oil. Such specifications can include having a kinematic viscosity at 40° C. of 2.0 to 11.0 cSt (ASTM D445), a calculated cetane index of 40 or more (ASTM D4737), a density at 15° C. of 0.90 g/cm$^3$ or less (ASTM D1298), an ash content of 0.01 wt % or less (ASTM D482), and a lubricity of 520 μm or less The marine gas oil compositions described herein can be used in various types of engines that may be present on a marine vessel that operates (at least in part) based on marine gas oil. Engines that can be operated using marine gas oil include marine engines for movement of a vessel and electrical generators for providing electrical power on a vessel. Depending on the type of engine, in some aspects an engine (either a marine engine or a generator) can be operated at various types of loads. Generally, the load on an engine can range anywhere from a minimum load (idle speed) up to 100% load. Some loads can correspond to relatively low loads of 30% or less, such as down to an idle speed or load for the engine. Other loads can correspond to relatively high loads of 75% or more, such as up to 100% load. It is noted that a marine engine for movement of a vessel can typically operate at a load that closer to 100% than 50%.

Determining Blend Limits Using ASTM D86

In various aspects, it has been unexpectedly discovered that the amount of lubricant base stock that can be blended into a marine gas oil while still providing a friction-reduction benefit can be determined based on characterizing a distillation profile for the marine gas oil using the method described in ASTM D86. When a marine gas oil sample has an excess of lubricant base stock, the distillation curve generated according to ASTM D86 can exhibit a curve inversion. By contrast, marine gas oil blends that include a suitable amount of lubricant base stock can produce a distillation curve having the expected monotonically increasing profile.

ASTM D86 is an ASTM method for determining the distillation curve for a petroleum sample at atmospheric pressure. Because it is an atmospheric distillation, the method is conventionally considered suitable for determination of distillation curves for samples with end points of roughly 365° C. or less.

Conventionally, a marine gas oil composition including a 1.0 vol % or more of a lubricant base stock would be considered not suitable for characterization using D86, due to the presence of components in the composition with a distillation point of 380° C. or more, or 400° C. or more. However, in spite of the presence of components boiling above 400° C., it has been discovered that the D86 method can be used to determine whether the amount of lubricant base stock added to a marine gas oil composition can provide a friction-reducing benefit.

When used on a conventional marine gas oil sample, a D86 distillation can result in a distillation curve where the distillation temperature monotonically increases with increasing weight of material distilled. Addition of lubricant base stock to a marine gas oil composition can cause the resulting D86 distillation to flatten out as the distillation approaches 95 vol % of material distilled. For suitable amounts of lubricant base stock, the flattening of the distillation curve can result in a curve that is still monotonically increasing, or a curve that has one or more regions where the temperature is substantially constant. A portion of a distillation curve is defined as having a substantially constant temperature when the temperature changes by 1.0° C. or less during distillation of 5 vol % or more of the sample. It is noted that a temperature change of 1.0° C. or less can include both increases and decreases in the distillation temperature. A monotonically increasing curve or a curve that includes one or more regions where the temperature is substantially constant can be in contrast to a distillation curve where the curve includes an inversion. When the amount of lubricant base stock is greater than the amount suitable for providing a friction-reducing benefit, at least one portion of the D86 distillation curve can include an inversion, which correspond temperature decrease of 1.0° C. or more as the distilled weight is increased.

In some aspects, the amount of lubricant base stock that can be added to a marine gas oil composition without causing an inversion in the D86 distillation curve can vary depending on the nature of the base stock. For high viscosity index base stocks, such as bright stock, the amount of lubricant base stock that can be included in a marine gas oil composition can correspond to 5.0 vol % or less. For base stocks with lower values of viscosity index, such as heavy neutral base stocks, the amount of base stock that can be included without causing an inversion of the D86 distillation curve can be 12 vol % or less, or 10 vol % or less. For still lower values of viscosity index, it may not be possible to observe curve inversion. For example, when adding light neutral base stock, curve inversion does not occur when adding smaller amounts of base stock. At higher amounts of base stock, such as 30 vol % or more, more than 5.0 vol % of the material does not boil under the ASTM D86 test conditions. As a result, it is believed that up to 30 vol % of light neutral base stock can be added while still obtaining the friction-reducing benefit.

FIG. 1 shows an example of distillation curves for a marine gas oil, and blends of the marine gas oil with various amounts of a bright stock. The bright stock had an initial boiling point of greater than 440° C., a viscosity index of greater than 80, and a kinematic viscosity at 40° C. of 440 cSt. As shown in FIG. 1, addition of 5 vol % bright stock to the marine gas oil composition results in a flattening of the distillation curve, but an inversion does not occur. By contrast, addition of 8 vol % or 10 vol % bright stock results in a D86 distillation curve where a decrease in distillation temperature of more than 1.0° C. occurs near the end of the distillation (i.e., an inversion in the distillation curve).

Figure 8:
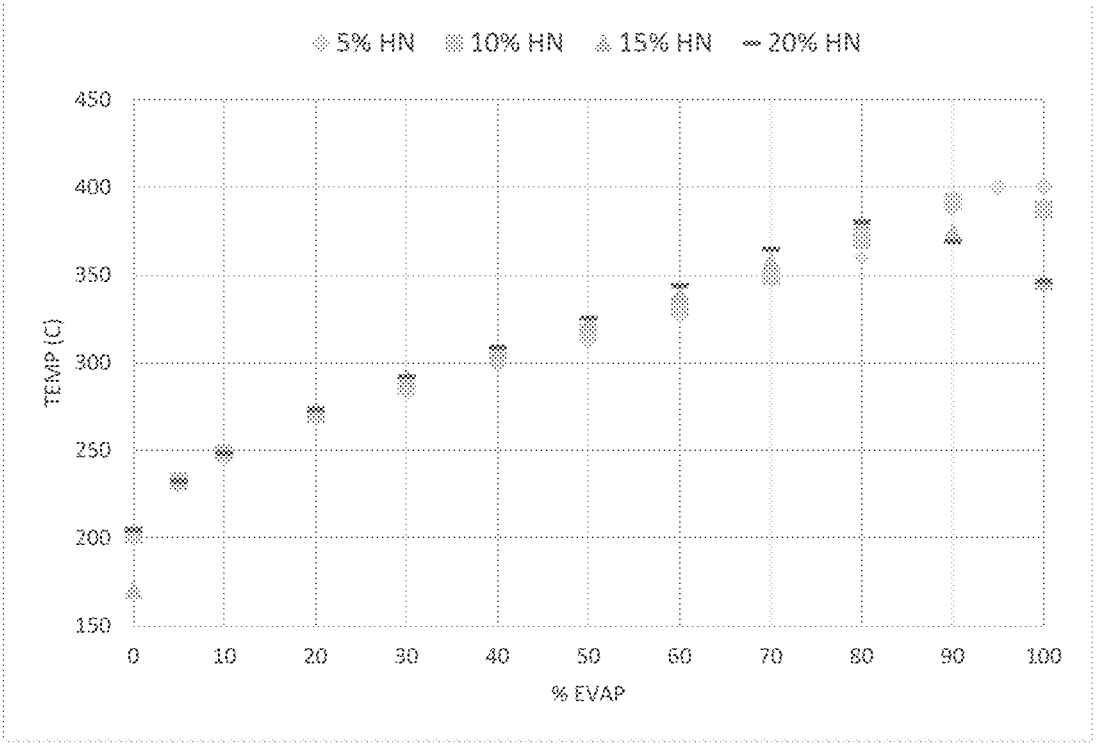
FIG. 8 shows distillation curves for marine gas oil compositions that include various amounts of heavy neutral base stock.

FIG. 8 shows an example of distillation curves for blends of marine gas oil with various amounts of a heavy neutral base stock. As shown in FIG. 8, additional heavy neutral base stock can be added prior to observing an inversion in the D86 distillation curve. The curve inversion does not occur with heavy neutral base stock until roughly 15 vol % of the marine gas oil composition corresponds to base stock.

Figure 9:
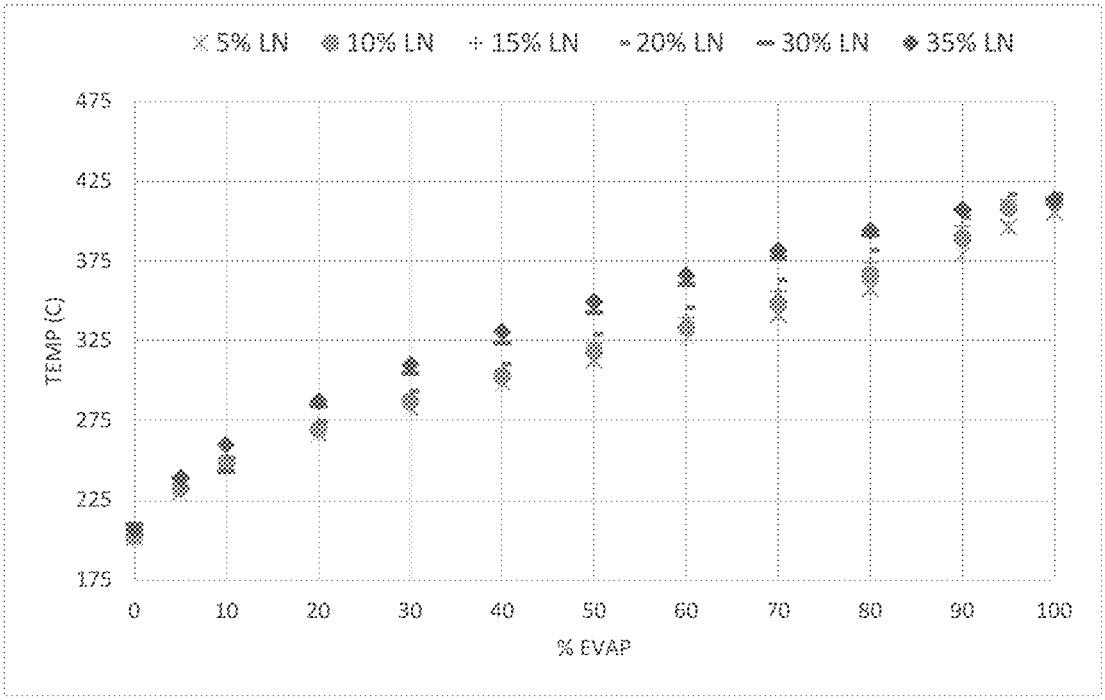
FIG. 9 shows distillation curves for marine gas oil compositions that include various amounts of light neutral base stock.

FIG. 9 shows distillation curves for blends of marine gas oil with various amounts of light neutral base stock. Unlike FIG. 1 and FIG. 8, a curve inversion is not shown in FIG. 9. However, it is noted that the data series corresponding to 30 vol % and 35 vol % addition of light neutral base stock do not include a data point for 95 vol % distillation. For marine gas oil compositions with 30 vol % or more light neutral base stock, the final boiling point of the composition under the ASTM D86 conditions is below 95 vol %. Without being bound by any particular theory, it is believed that this also indicates a limit on the amount of light neutral that can be added in order to obtain the friction-reducing benefit.

Characterization of Friction for Marine Gas Oils Including Lubricant Base Stock The friction-reducing benefits of incorporating a base stock into a marine gas oil composition can be demonstrated based on a comparison of the indicated mean effective pressure with the actual work delivered by an engine. The indicated mean effective pressure (IMEP) corresponds to the mean or average pressure measured within an engine cylinder over the compression and expansion stroke in the cycle. Thus, the IMEP corresponds to an idealized amount of work per unit volume that could be generated. The difference between this idealized amount of work and the actual amount of work generated per unit volume by the cylinder (or by the corresponding engine) can be used to determine an amount of frictional loss that corresponds to the frictional mean effective pressure. It is noted that the "actual amount of work" can also be referred to as the brake mean effective pressure (BMEP).

In order to investigate the ability to reduce or minimize frictional losses, three types of fuels were tested in an engine environment. One fuel corresponded to an automotive ultra-low sulfur diesel fuel with a sulfur content of 15 wppm or less and a cetane index of 50 or more. A second fuel corresponded to a reference fuel. The reference fuel included 68 vol % of a commercially available marine gas oil and 32 vol % of the ultra-low sulfur diesel. A third fuel corresponded to a blend of the reference fuel with 5 vol % of a bright stock. The bright stock had an initial boiling point of greater than 440° C., a viscosity index of greater than 80, and a kinematic viscosity at 40° C. of 440 cSt.

During the engine testing, three runs were performed using each type of fuel in order to generate statistics. The fuels were tested in the engine at an idle speed, at 50% load, and at 100% load. The fuels were tested in the engine to determine indicated mean effective pressure (IMEP) and to determine the horsepower generated by the engine. These quantities were then used to calculate a frictional mean effective pressure (FMEP).

Figure 2:
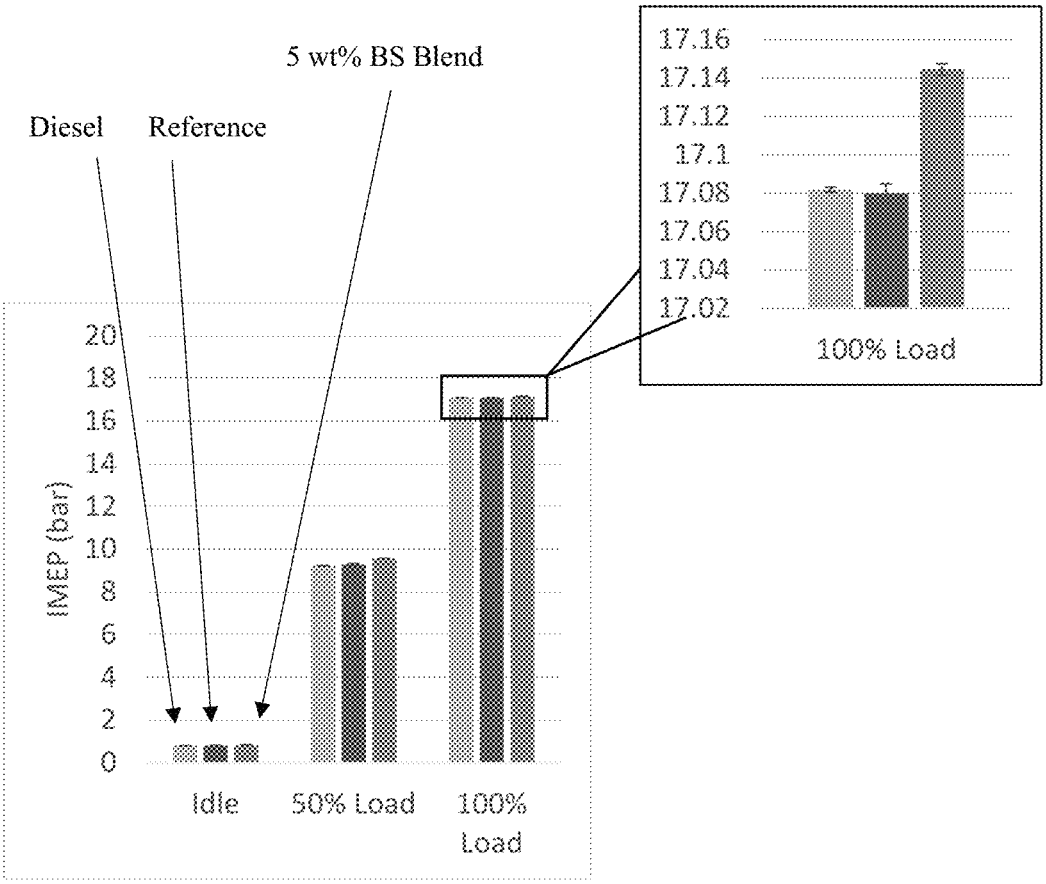
FIG. 2 shows induced mean effective pressure for an engine operated with various fuels.

FIG. 2 shows the IMEP results from the testing of the three types of fuel. For each engine condition, the left bar corresponds to the IMEP for the diesel fuel, the middle bar corresponds to the reference fuel, and the right bar corresponds to the blend of the reference fuel with 5 vol % brightstock.

As shown in FIG. 2, the IMEP for the three types of fuel was comparable at each engine condition, but the blend that included the 5 vol % brightstock provided the highest IMEP at both 50% power and at 100% power. It is noted that for the test at 100% power, the offset portion of the figure shows a pressure increase of 0.06 bar for the blend fuel relative to the reference fuel.

Figure 3:
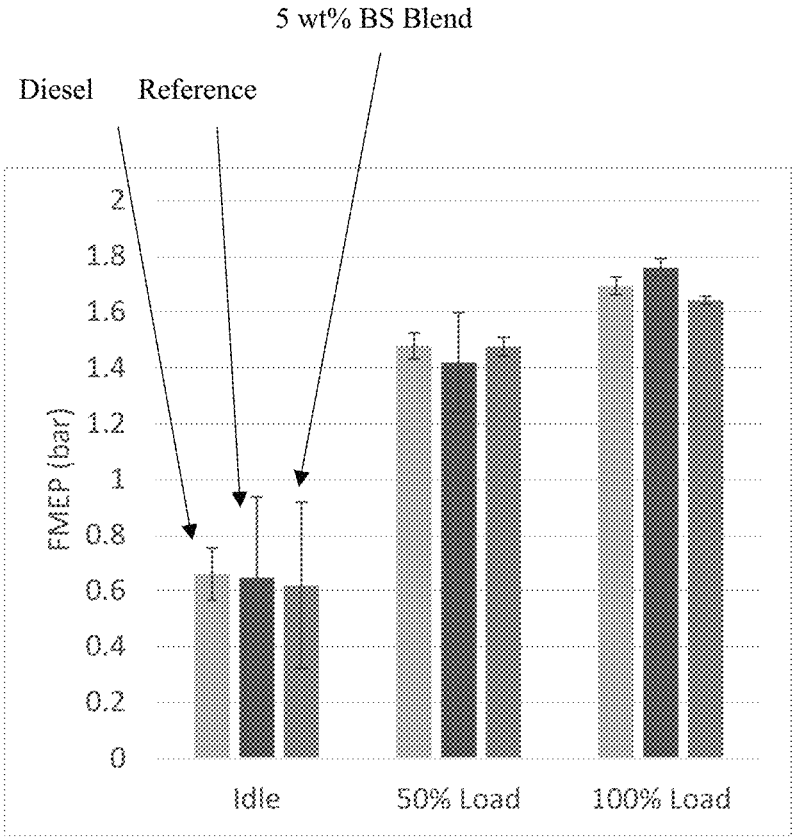
FIG. 3 shows frictional mean effective pressure for an engine operated with various fuels.

Because the blend including 5 vol % brightstock provided at least a comparable IMEP to the comparative diesel fuel and the reference fuel, any improvement in the FMEP represents an improvement in the power delivered by the engine. The FMEP for each test condition is shown in FIG. 3. As shown in FIG. 3, the blend including 5 vol % brightstock provided the lowest FMEP at both the idle condition and at the 100% load condition. In particular, at the 100% load condition, the blend including 5 vol % brightstock had a FMEP that was lower than the reference fuel by 0.1-0.2 bar. At 100% load, this reduction in FMEP for the blend including 5 vol % brightstock roughly corresponds to a 0.5% to 1% increase in the power output for the engine relative to the reference marine gas oil. Based on the comparable or increased value of IMEP for the fuel blend including 5 vol % brightstock, the unexpected reduction in FMEP corresponds to an unexpected power advantage for operating an engine using a fuel that includes lubricant base stock. As noted above, it is believed that the 100% load condition is more representative of typical marine engine operation than the 50% or idle condition As another example, the reference fuel, the blend including 5 vol % of bright stock, and another comparative marine gas oil were tested in a reciprocating bench top rig in order to determine the friction coefficient with each fuel sample. The bench top rig was designed to simulate the piston ring/cylinder wall friction that would be present in an engine. The test was structured to operate at high load (120 N), high speed (20 Hz), and 120° C. In the bench top rig, as the cylinder plate was reciprocating back and forth, the fuel was drip fed onto the plate to provide lubrication. After 1 hour, the drip feed was stopped to simulate the evaporative effect within an engine cylinder. The test was designed to run for roughly 7 hours.

Figure 4:
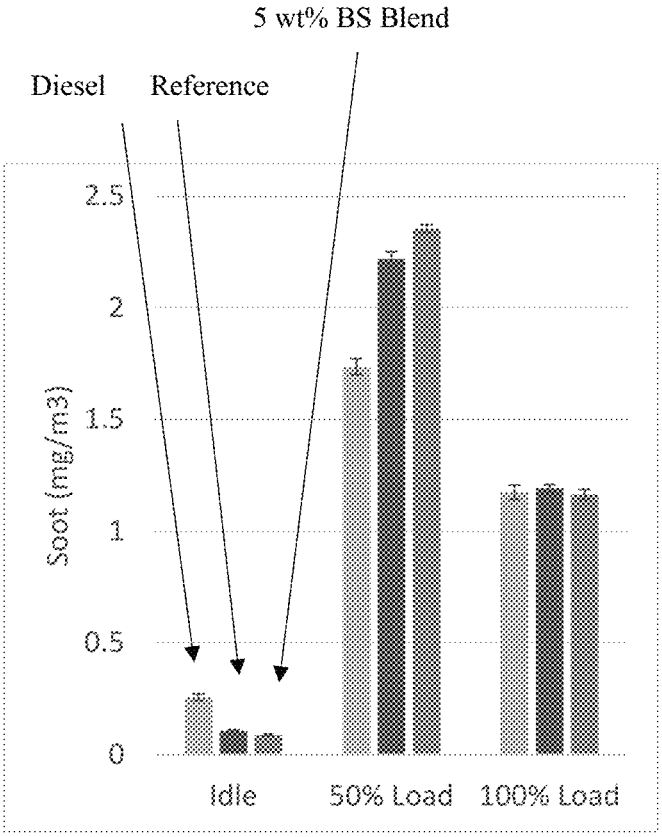
FIG. 4 shows the amount of soot in the emissions of an engine operated with various fuels.

FIG. 4 shows the results from the bench top rig test. As an initial note, the run using the additional comparative marine gas oil resulted in the bench top rig freezing halfway through the time period (after roughly 3 hours). The friction coefficient measured for the comparative marine gas oil prior to the freezing of the rig was also higher than the other samples.

For the reference fuel and the blend with 5 vol % bright stock, the addition of the bright stock reduced the friction coefficient resulted in a lower friction coefficient for the entire length of the test run. The difference in friction coefficient was greater during the initial period when the fuel was being dripped onto the cylinder plate. The difference in friction coefficient then slowly became smaller over time after the drip period ended.

Without being bound by any particular theory, it is believed that the reduction in FMEP and/or the improvement in IMEP is due to the high boiling components from the lubricant base stock not immediately evaporating during engine operation. Instead, when the high boiling components are sprayed into the cylinder, the high boiling components are sprayed on to the piston ring/cylinder wall boundary. The presence of this liquid at the boundary provides additional lubrication and friction reduction at the top of the piston stroke. At the top of the piston stroke, the cylinder wall/piston ring are in the boundary region of the Stribeck curve. This is the highest friction portion of the Stribeck curve, so the ability of the lubricant base stock to provide additional lubrication at the top of the piston stroke can provide an unexpected benefit.

It is noted that the friction-reducing benefit of incorporating a base stock into a marine gas oil may be difficult to identify using other conventional methods. As an example, a common method for characterization of distillate fuel lubricity is ASTM D6079, which uses a High Frequency Reciprocating Rig (HFRR) to generate a wear scar on a sample. The wear scar typically has an oval shape, so the wear scar can be characterized based on an average diameter. The average diameter is determined by measuring a length and a height of the oval and averaging the distances. The wear scar diameter provides an indication of the fuel lubricity. However, the diameter of the wear scar is believed to be related to mixed lubrication and/or hydrodynamic lubrication portions of the Stribeck curve. As a result, the unexpected benefits in the boundary portion of the Stribeck curve due to addition of base stock to marine gas oil are not directly observable based on wear scar diameter.

In order to illustrate the difficulty in observing the friction-reducing benefit using a conventional test method, the reference fuel, the blend including 5 vol % brightstock, and another comparative marine gas oil were tested in an HFRR test rig according to D6079. The reference marine gas oil resulted in a wear scar diameter of 376.0 μm. The additional comparative marine gas oil resulted in a wear scar diameter of 399.5 μm. The blend including the 5 vol % brightstock resulted in a wear scar diameter between the diesel and reference marine gas oil of 388.5 μm. Thus, in spite of the friction-reducing benefits shown in FIG. 2 and FIG. 3, the HFRR results do not indicate any benefit from use of the blend including the 5 vol % of lubricant base stock.

Impact of Base Stock on Engine Emissions

Although the addition of lubricant base stock to a marine gas oil composition provides friction-reducing benefits, it would be expected conventionally that addition of higher boiling components to a marine fuel would result in increased emissions. Examples of potential emission types that could increase include soot, total hydrocarbons (THC), and nitrogen oxides (NOx). It has been unexpectedly discovered that addition of base stock to a marine gas oil composition did not result in increased emissions when using the marine gas oil composition as a fuel. Instead, the emissions were comparable to or lower than the emissions from using a conventional marine gas oil.

Figure 5:
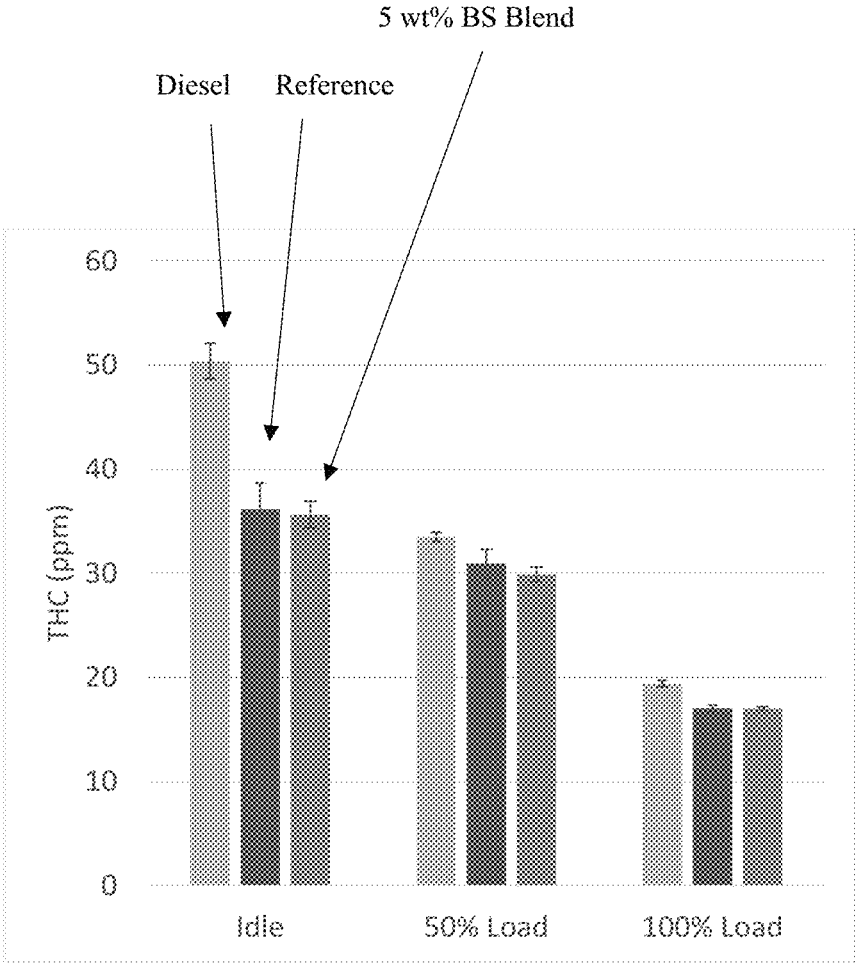
FIG. 5 shows the amount of total hydrocarbons in the emissions of an engine operated with various fuels.
Figure 6:
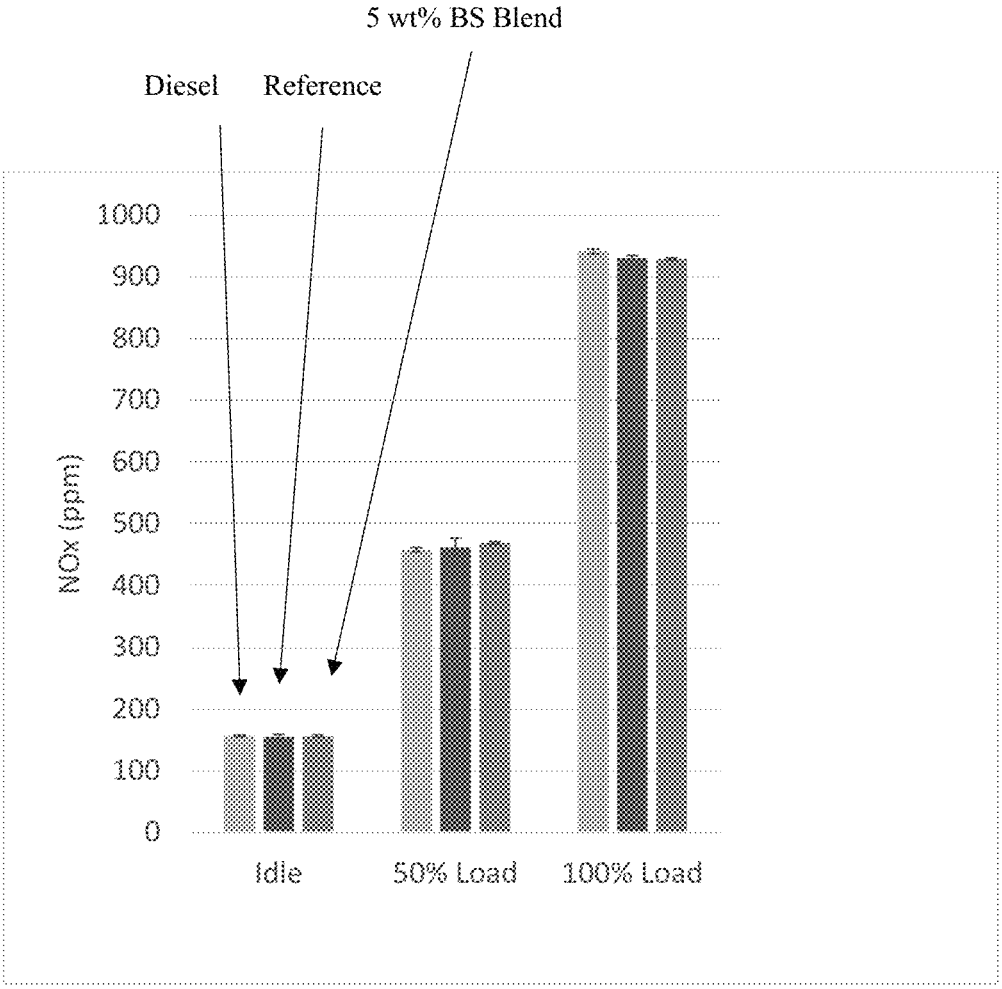
FIG. 6 shows the amount of NOx in the emissions of an engine operated with various fuels.
Figure 7:
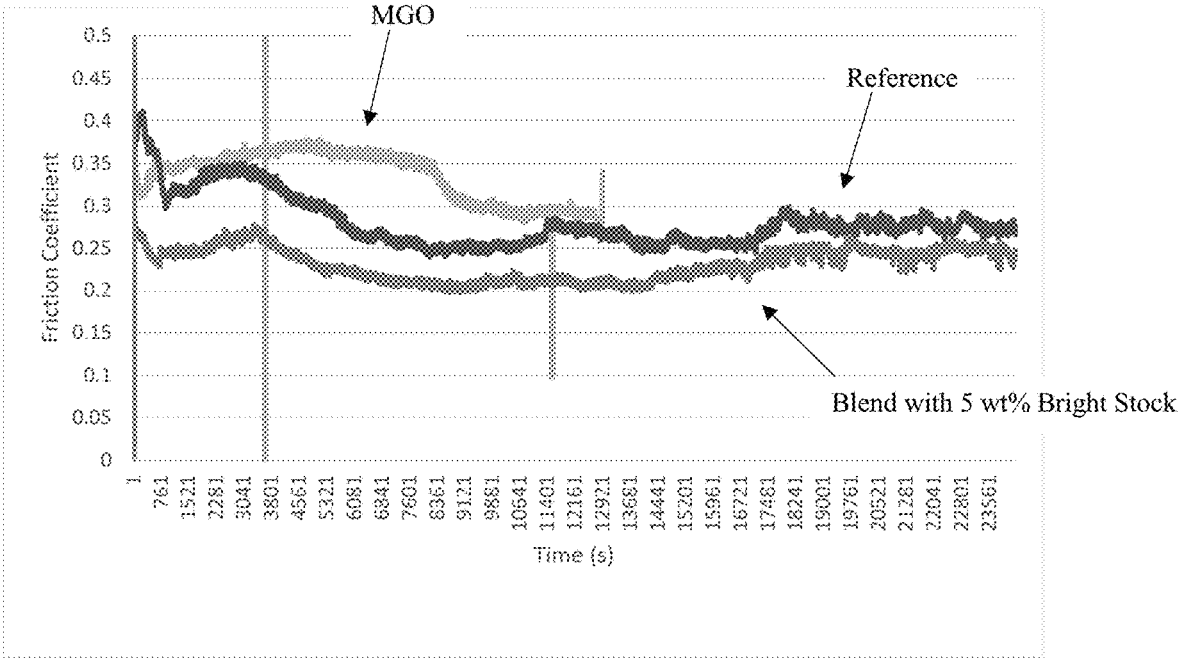
FIG. 7 shows the friction coefficient during operation of a reciprocating bench rig operated with various fuels.

During the engine testing to determine the IMEP and FMEP, the emissions from the engine were also characterized to determine the amounts of soot, total hydrocarbons, and NOx. FIG. 5 shows the amount of soot in the engine exhaust, FIG. 6 shows the total hydrocarbons in the exhaust, and FIG. 7 shows the NOx in the exhaust. Similar to FIG. 2 and FIG. 3, the left hand bar in each graph corresponds to the ultra-low sulfur diesel fuel, the middle bar corresponds to the reference fuel (68 vol % marine gas oil, 32 vol % ultra-low sulfur diesel), and the right bar corresponds to the blend corresponding to the reference fuel blended with 5 vol % of brightstock.

FIG. 5 shows that the blend including 5 vol % of bright stock resulted in comparable soot emissions to the reference fuel at all engine loads. The blend including 5 vol % brightstock resulted in modestly higher emissions at 50% load, while providing slightly lower emissions at idle or at 100% load. There was more variation relative to the ultra-low sulfur diesel.

FIG. 6 shows that the total hydrocarbons in the engine exhaust was comparable or reduced relative to both the ultra-low sulfur diesel and the reference fuel. This trend held at the idle, 50% load, and 100% load conditions. Similarly, FIG. 7 shows that the amount of NOx emitted was comparable at all engine conditions that were tested.

In spite of the increased boiling range due to the addition of lubricant base stock, the blend including 5 vol % bright stock unexpectedly resulted in comparable emissions to reference marine gas oil composition while also providing reduced frictional losses.

Additional Embodiments

Embodiment 1. A marine gas oil composition comprising 1.0 vol % to 25 vol % of a lubricant base stock, the lubricant base stock comprising a T5 distillation point of 350° C. or more, a kinematic viscosity at 100° C. of 3.0 cSt or more, and a viscosity index of 80 or more, the marine gas oil composition comprising a density at 15° C. of 0.81 g/cm$^3$ to 0.90 g/cm$^3$ (or 0.81 g/cm$^3$ to 0.89 g/cm$^3$), a calculated cetane index of 40 or more, and a kinematic viscosity at 40° C. of 2.0 cSt to 11.0 cSt (or 2.0 cSt to 6.0 cSt).

Embodiment 2. The marine gas oil composition of Embodiment 1, wherein 50 vol % or more of the lubricant base stock has a distillation point of 380° C. or more (or 400° C. or more); or wherein the lubricant base stock comprises a T5 distillation point of 380° C. or more; or a combination thereof.

Embodiment 3. The marine gas oil composition of any of the above embodiments, wherein the lubricant base stock comprises a hydroprocessed deasphalted oil, or wherein the lubricant base stock comprises 50 wt % or more naphthenes, or a combination thereof.

Embodiment 4. The marine gas oil composition of any of the above embodiments, wherein the lubricant base stock comprises a kinematic viscosity at 100° C. of 3.0 cSt to 6.0 cSt; or wherein the lubricant base stock comprises a kinematic viscosity at 40° c of 14 cSt to 40 cSt; or a combination thereof.

Embodiment 5. The marine gas oil composition of any of Embodiments 1-3, wherein the marine gas oil comprises 1.0 vol % to 12 vol % of the lubricant base stock, the lubricant base stock optionally comprising a kinematic viscosity at 100° C. of 6.5 cSt to 12 cSt, a kinematic viscosity at 40° C. of 32 cSt to 160 cSt, or a combination thereof.

Embodiment 6. The marine gas oil composition of any of Embodiments 1-3, wherein the marine gas oil comprises 1.0 vol % to 5.0 vol % of the lubricant base stock, the lubricant base stock optionally comprising a kinematic viscosity at 100° C. of 14 cSt to 40 cSt, a kinematic viscosity at 40° C. of 115 cSt to 875 cSt, or a combination thereof.

Embodiment 7. The marine gas oil composition of any of the above embodiments, wherein the lubricant base stock comprises a viscosity index of 80 to 120.

Embodiment 8. The marine gas oil composition of any of Embodiments 1-6, wherein the lubricant base stock comprises a viscosity index of greater than 120.

Embodiment 9. The marine gas oil composition of any of the above embodiments, wherein the lubricant base stock comprises 1 wt % or less of aromatics, or wherein the marine gas oil composition is clear and bright according to Procedure 1 of ASTM D4176, or a combination thereof.

Embodiment 10. The marine gas oil composition of any of the above embodiments, wherein the marine gas oil composition comprises a D86 distillation curve that is monotonically increasing.

Embodiment 11. The marine gas oil composition of any of Embodiments 1-9, wherein the marine gas oil composition comprises a D86 distillation curve that does not include an inversion of greater than 1° C.

Embodiment 12. The marine gas oil composition of any of the above embodiments, wherein the marine gas oil composition comprises a sulfur content of 1000 wppm or less.

Embodiment 13. A method for operating an engine, the method comprising operating the engine using a fuel comprising the marine gas oil composition of any of Embodiments 1-12, the engine optionally comprising a marine diesel engine.

Embodiment 14. The method of Embodiment 13, the method further comprising operating the engine at a load of 75% or more.

Embodiment 15. The method of Embodiment 13, the method further comprising operating the engine at a load of 30% or less.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A marine gas oil composition comprising 1.0 vol % to 25 vol % of a lubricant base stock, the lubricant base stock comprising a T5 distillation point of 350° C. or more, a kinematic viscosity at 100° C. of 3.0 cSt or more, and a viscosity index of 80 or more, the marine gas oil composition comprising a density at 15° C. of 0.81 g/cm$^3$ to 0.90 g/cm$^3$, a calculated cetane index of 40 or more, and a kinematic viscosity at 40° C. of 2.0 cSt to 11.0 cSt.

2. The marine gas oil composition of claim 1, wherein the marine gas oil composition comprises a D86 distillation curve that is monotonically increasing.

3. The marine gas oil composition of claim 1, wherein the marine gas oil composition comprises a D86 distillation curve that does not include an inversion of greater than 1° C.

4. The marine gas oil composition of claim 1, wherein 50 vol % or more of the lubricant base stock has a distillation point of 380° C. or more.

5. The marine gas oil composition of claim 1, wherein the lubricant base stock comprises a hydroprocessed deasphalted oil.

6. The marine gas oil composition of claim 5, wherein the lubricant base stock comprises 50 wt % or more naphthenes.

7. The marine gas oil composition of claim 1, wherein the lubricant base stock comprises a kinematic viscosity at 100° C. of 3.0 cSt to 6.0 cSt; or wherein the lubricant base stock comprises a kinematic viscosity at 40° c of 14 cSt to 40 cSt; or a combination thereof.

8. The marine gas oil composition of claim 1, wherein the marine gas oil comprises 1.0 vol % to 12 vol % of the lubricant base stock.

9. The marine gas oil composition of claim 8, wherein the lubricant base stock comprises a kinematic viscosity at 100° C. of 6.5 cSt to 12 cSt, a kinematic viscosity at 40° C. of 32 cSt to 160 cSt, or a combination thereof.

10. The marine gas oil composition of claim 1, wherein the marine gas oil comprises 1.0 vol % to 5.0 vol % of the lubricant base stock.

11. The marine gas oil composition of claim 10, wherein the lubricant base stock comprises a kinematic viscosity at 100° C. of 14 cSt to 40 cSt, a kinematic viscosity at 40° C. of 115 cSt to 875 cSt, or a combination thereof.

12. The marine gas oil composition of claim 1, wherein the lubricant base stock comprises a viscosity index of 80 to 120.

13. The marine gas oil composition of claim 1, wherein the lubricant base stock comprises a viscosity index of greater than 120.

14. The marine gas oil composition of claim 1, wherein the lubricant base stock comprises 1 wt % or less of aromatics.

15. The marine gas oil composition of claim 1, wherein the marine gas oil composition is clear and bright according to Procedure 1 of ASTM D4176.

16. The marine gas oil composition of claim 1, wherein the marine gas oil composition comprises a sulfur content of 1000 wppm or less.

17. A method for operating an engine, the method comprising operating the engine using a fuel comprising the marine gas oil composition of claim 1.

18. The method of claim 17, wherein the engine comprises a marine diesel engine.

19. The method of claim 17, the method further comprising operating the engine at a load of 75% or more.

20. The method of claim 17, the method further comprising operating the engine at a load of 30% or less.

* * * * *